US011913191B2

(12) United States Patent
Thiessen

(10) Patent No.: US 11,913,191 B2
(45) Date of Patent: Feb. 27, 2024

(54) FLOATING EARTH LEVELLING BLADE ASSEMBLY WITH SHOES

(71) Applicant: Tylan Thiessen, Neilburg (CA)

(72) Inventor: Tylan Thiessen, Neilburg (CA)

(73) Assignee: 2376016 Alberta Inc., Calgary (CA)

( * ) Notice: Subject to any disclaimer, the term of this patent is extended or adjusted under 35 U.S.C. 154(b) by 587 days.

(21) Appl. No.: 17/065,071

(22) Filed: Oct. 7, 2020

(65) Prior Publication Data

US 2021/0131059 A1 May 6, 2021

Related U.S. Application Data

(60) Provisional application No. 62/931,449, filed on Nov. 6, 2019.

(51) Int. Cl.
*E02F 3/76* (2006.01)
*E02F 3/36* (2006.01)
*E02F 3/815* (2006.01)

(52) U.S. Cl.
CPC ..... *E02F 3/7618* (2013.01); *E02F 3/3677* (2013.01); *E02F 3/8155* (2013.01)

(58) Field of Classification Search
CPC ..... E02F 3/3677; E02F 3/8155; E02F 3/358; E02F 3/7631; E02F 3/7618
See application file for complete search history.

(56) References Cited

U.S. PATENT DOCUMENTS 2,224,725 A * 12/1940 Felt, Jr. ..... E02F 3/7613 172/823
2,753,638 A * 7/1956 Mork ..... E02F 3/7618 172/825
3,083,480 A * 4/1963 Kirchler ..... E02F 3/7618 172/825
3,084,461 A * 4/1963 Beckford ..... E02F 3/7613 172/821
3,182,831 A * 5/1965 Bergmann ..... E02F 3/34 414/722
3,670,825 A * 6/1972 Asal ..... E02F 3/7627 37/234
3,822,751 A * 7/1974 Waterman ..... E02F 3/7631 172/825

(Continued)

*Primary Examiner* — Jamie L McGowan
(74) *Attorney, Agent, or Firm* — Ryan W. Dupuis; Kyle R. Satterthwaite; Ade & Company Inc.

(57) ABSTRACT

An earth levelling blade assembly for mounting on the lift arms of a loader includes a laterally extending main blade and two shoes supported at opposing ends of the main blade for sliding engagement along the ground. The shoes are supported for movement between a forward position ahead of the main blade and a rearward position behind the main blade, as well as being adjustable in height relative to a bottom cutting edge of the main blade. A coupling arrangement between a first mounting frame on the lift arms of the loader and a second mounting frame on the rear mounting face of the main blade (i) supports the second mounting frame to be freely pivotal about a forward axis relative to the first mounting frame in which the forward axis is oriented in the forward working direction of the loader and (ii) supports the second mounting frame to freely translate relative to the first mounting frame along an upright axis.

19 Claims, 8 Drawing Sheets

(56) References Cited

U.S. PATENT DOCUMENTS 3,926,263 A * 12/1975 Frisbee ..... E02F 3/80 172/825
4,013,132 A * 3/1977 Matsuzawa ..... E02F 3/7613 172/821
4,026,368 A * 5/1977 Asal ..... E02F 3/7618 172/827
4,147,262 A * 4/1979 Umeda ..... E02F 9/121 414/697
4,211,282 A * 7/1980 Frisbee ..... E02F 3/844 280/446.1
4,249,323 A * 2/1981 Mathis ..... E01H 5/065 37/232
4,281,721 A * 8/1981 Beales ..... E02F 3/7613 172/821
4,450,635 A * 5/1984 Shwayder ..... E01H 5/061 37/271
5,121,557 A * 6/1992 Moore ..... E02F 3/352 37/406
5,562,398 A * 10/1996 Knutson ..... E02F 3/3677 414/732
5,732,781 A * 3/1998 Chambers ..... E02F 3/627 172/825
5,819,444 A * 10/1998 Desmarais ..... E01H 5/065 37/234
6,360,459 B1 * 3/2002 Brookhart ..... E02F 3/345 37/234
6,668,471 B1 * 12/2003 Cook ..... E02F 3/7618 37/410
7,351,028 B2 * 4/2008 Potter ..... E02F 3/3677 403/348
7,360,327 B2 * 4/2008 Osgood ..... E02F 3/8155 37/444
7,584,557 B1 * 9/2009 Nistler ..... E01H 5/065 37/234
8,678,103 B2 * 3/2014 Miyuki ..... E02F 3/7631 172/813
10,106,942 B2 * 10/2018 Roberge ..... E01H 5/061
10,584,464 B2 * 3/2020 Armstrong ..... E02F 3/8157
11,047,106 B2 * 6/2021 Babl ..... E02F 3/3677
2006/0182599 A1 * 8/2006 Potter ..... E02F 3/3677 414/723
2007/0235202 A1 * 10/2007 Mullett ..... E02F 3/8157 172/393
2010/0326684 A1 * 12/2010 Mullett ..... E02F 3/7618 172/772
2011/0067892 A1 * 3/2011 Miyuki ..... E02F 3/7631 172/813
2014/0212244 A1 * 7/2014 Meyer ..... A01D 87/127 414/24.5
2016/0069032 A1 * 3/2016 Winter ..... E01H 5/066 37/270
2019/0040606 A1 * 2/2019 Armstrong ..... E02F 3/7627
2019/0119881 A1 * 4/2019 Honermann ..... E02F 3/966
2020/0102717 A1 * 4/2020 Sharp ..... E02F 3/8155
2021/0131059 A1 * 5/2021 Thiessen ..... E02F 3/7613
2022/0349148 A1 * 11/2022 Kumbhar ..... E02F 3/40

* cited by examiner

FLOATING EARTH LEVELLING BLADE ASSEMBLY WITH SHOES

This application claims the benefit under 35 U.S.C.119(e) of U.S. provisional application Ser. No. 62/931,449, filed Nov. 6, 2019 and claims foreign priority benefits from Canadian Patent Application 3,079,725 filed Apr. 29, 2020.

FIELD OF THE INVENTION

The present invention relates to an earth levelling blade assembly comprising an earth levelling blade arranged to be supported in floating relation to the lift arms of a loader and/or an earth levelling blade having shoes for riding on the ground which are adjustable in height relative to the earth levelling blade.

BACKGROUND

Various assemblies are known for supporting blades of various types onto the lift arms of a loader or excavator. In some instances, the blade can be supported for pivotal movement about a forward axis oriented transversely to the lateral direction that the bottom cutting edge of the blade extends to allow side to side tilting of the blade relative to the loader or excavator. Some examples of relative pivotal movement between a blade and a lift arm about a forward axis perpendicular to the bottom cutting edge of the blade are described in U.S. Pat. No. 4,512,090 by Billings, U.S. Pat No. 5,562,398 by Knutson, and 2001/045031 by Holmes et al. In each instance, when side to side tilting is permitted, any raising of one side of the blade must be accompanied by a corresponding lowering of the opposing side of the blade. When used with a leveling blade for leveling earth, this may be undesirable because raising of one end of the blade to pass over an elevated ground contour results in the opposing end of the blade digging deeper into the ground than is desired so that leveling with the blade in this manner is difficult.

SUMMARY OF THE INVENTION

According to one aspect of the invention there is provided an earth levelling blade assembly for supporting a levelling blade having a front working face and a rear mounting face on the lift arms of a loader movable across ground in a forward working direction, the assembly comprising:

- a first mounting frame arranged to be releasably attached onto the lift arms of the loader;
- a second mounting frame arranged to be fixedly attached to the rear mounting face of the levelling blade;
- a coupling arrangement between the first and second mounting frames that (i) supports the second mounting frame to be freely pivotal about a forward axis relative to the first mounting frame in which the forward axis is oriented in the forward working direction of the loader and (ii) supports the second mounting frame to freely translate relative to the first mounting frame along an upright axis.

Providing a coupling arrangement which allows both free pivotal movement about a forward axis together with free translating movement along an upright axis between a leveling blade and the corresponding lift arms of a loader allows the leveling blade to truly follow ground contours because one end of the blade passing over an elevated ground contour does not result in the opposing end of the blade digging deeper into the ground than is desired.

Preferably the second mounting frame is coupled to the first mounting frame such that the second mounting frame can translate along the upright axis relative to the first mounting frame without any corresponding rotation of the second mounting frame relative to the first mounting frame about the forward axis.

According to the illustrated embodiments one of the first and second mounting frames comprises a mounting plate and the other one of the first and second mounting frames comprises a pair of channels receiving opposing side edges of the mounting plate slidably therein. More particularly, in the illustrated embodiment, the first mounting frame comprises the mounting plate.

Preferably the side edges of the mounting plate are convex having a centre of curvature at the forward axis so as to enable the second mounting frame to be freely pivotal about the forward axis relative to the first mounting frame.

Preferably the channels extend in a direction of the upright axis such that the side edges of the mounting plate are slidable within the respective channels in the direction of the upright axis so as to enable the second mounting frame to freely translate relative to the first mounting frame along the upright axis.

The first mounting frame may further comprise (i) a first portion arranged to be secured to the lift arms of the loader, (ii) a second portion connected to the second mounting frame by the coupling arrangement, (iii) a pivot shaft pivotally coupling the second portion to the first portion for relative pivotal movement about an upright swing axis through a range of different angular orientations, and (iv) a locking member arranged to couple the second portion to the first portion in fixed relation to one another at a selected one of the different angular orientations.

In one embodiment, the levelling blade supported by the floating coupling arrangement above may comprise a box blade having (i) a main blade portion extending in a lateral direction transversely to the forward axis in which the main blade portion defines the front working face of the levelling blade and defines a bottom cutting edge of the levelling blade and (ii) a pair of side walls extending forwardly from laterally opposing ends of the main blade portion.

In further embodiments, the levelling blade may comprise a conventional grader blade in which the blade consists of a single cutting edge across the bottom of the blade extending between opposing ends of the blade.

In yet further embodiments, the levelling blade may further comprise: (i) a main blade portion extending in a lateral direction transversely to the forward axis in which the main blade portion defines the front working face of the levelling blade and defines a bottom cutting edge of the levelling blade, and (ii) a pair of side walls supported at laterally opposing ends of the main blade portion respectively; (iii) wherein each side wall is movable between a forward position extending forwardly from the respective end of the main blade portion and a rearward position extending rearwardly from the respective end of the main blade portion; and wherein (iv) the shoes are supported on the side walls respectively.

According to a second aspect of the present invention there is provided an earth levelling blade assembly for being supported on the lift arms of a loader movable across ground in a forward working direction, the assembly comprising:

- a levelling blade having a main blade portion extending in a lateral direction transversely to the forward working direction between opposing ends in which the main blade portion defines a front working face of the levelling blade and a bottom cutting edge of the levelling blade;

a first mounting frame arranged to be releasably attached onto the lift arms of the loader;

a second mounting frame fixedly attached to a rear mounting face of the levelling blade opposite from the forward working face of the blade;

a coupling arrangement coupling the first mounting frame on the second mounting frame; and two shoes supported at the opposing ends of the levelling blade respectively in which each shoe has a bottom face arranged for sliding engagement along the ground;

each shoe being supported on the respective side wall such that at least a portion of the shoe is adjustable in height relative to the bottom cutting edge of the main blade portion of the levelling blade.

Use of shoes which are height adjustable relative to the bottom cutting edges of the main blade portion permits the bottom cutting edge of the main portion of a leveling blade to be elevated relative to the shoes to provide an even, yet adjustable gap ideal for spreading material evenly across the ground with the shoes being lowered below the bottom of the blade. By further enabling the shoes to be elevated above the bottom cutting edges of the blades, the shoes can be moved to an out of use position which do not interfere with use of the blade to collect material close to obstacles, for example clearing or collecting snow from streets in close proximity to curbs.

Use of shoes which can be varied in elevation relative to the bottom cutting edge of a leveling blade together with an assembly which supports the leveling blade for full floating movement relative to the loader arms is particularly desirable for ensuring that the leveling blade can float across ground while being maintained at a consistent adjustable clearance gap between the bottom cutting edge of the leveling blade and the ground for optimum spreading of material on ground.

When the levelling blade comprises a box blade having a pair of side walls extending forwardly from the opposing ends of the main blade portion respectively, the shoes may be supported on the side walls of the box blade such that at least a rear portion of the shoe is adjustable in height relative to the bottom cutting edge of the main blade portion of the box blade. In this instance, each shoe preferably includes a side plate supported in an upright orientation alongside the respective side wall of the box blade so as to be adjustable relative to the side wall, and a bottom plate fixed onto the side plate so as to define the bottom face of the shoe.

The shoes may be movable relative to the box blade independently of one another.

An actuator may be coupled to each shoe which is operable to displace the shoe relative to the box blade. The actuator may be operable such that a portion of the shoe can be displaced to a lowermost position in which the bottom face of the shoe is spaced below an elevation of the bottom cutting edge of the main blade portion, and/or such that a portion of the shoe can be displaced to an uppermost position in which the bottom face of the shoe is spaced above an elevation of the bottom cutting edge of the main blade portion.

In the first illustrated embodiment, the side plate of each shoe is pivotally connected to the respective side wall of the box blade in proximity to a forward end of the side wall; however, in the second illustrated embodiment, the side plate of each shoe may be supported so as to be vertically slidable relative to the side wall of the respective box blade.

According to the second illustrated embodiment, the adjustable height shoes may be used with a levelling blade that further comprises: (i) a main blade portion extending in a lateral direction transversely to the forward axis in which the main blade portion defines the front working face of the levelling blade and defines a bottom cutting edge of the levelling blade, and (ii) a pair of side walls supported at laterally opposing ends of the main blade portion respectively; (iii) wherein each side wall is movable between a forward position extending forwardly from the respective end of the main blade portion and a rearward position extending rearwardly from the respective end of the main blade portion; and wherein (iv) the shoes are supported on the side walls respectively.

Each side wall may be pivotal about a respective upright pivot axis between the forward position and the rearward position thereof, in which the upright pivot axis of each side wall may be spaced rearwardly and spaced laterally inwardly from the respective end of the main blade portion.

Preferably the side walls are movable between the respective forward and rearward positions independently of one another.

Each shoe is preferably supported on the respective end of the levelling blade such that the bottom face is movable from a lowered position spaced below the bottom cutting edge of the levelling blade to a raised position at a common elevation with or spaced above the bottom cutting edge of the levelling blade.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
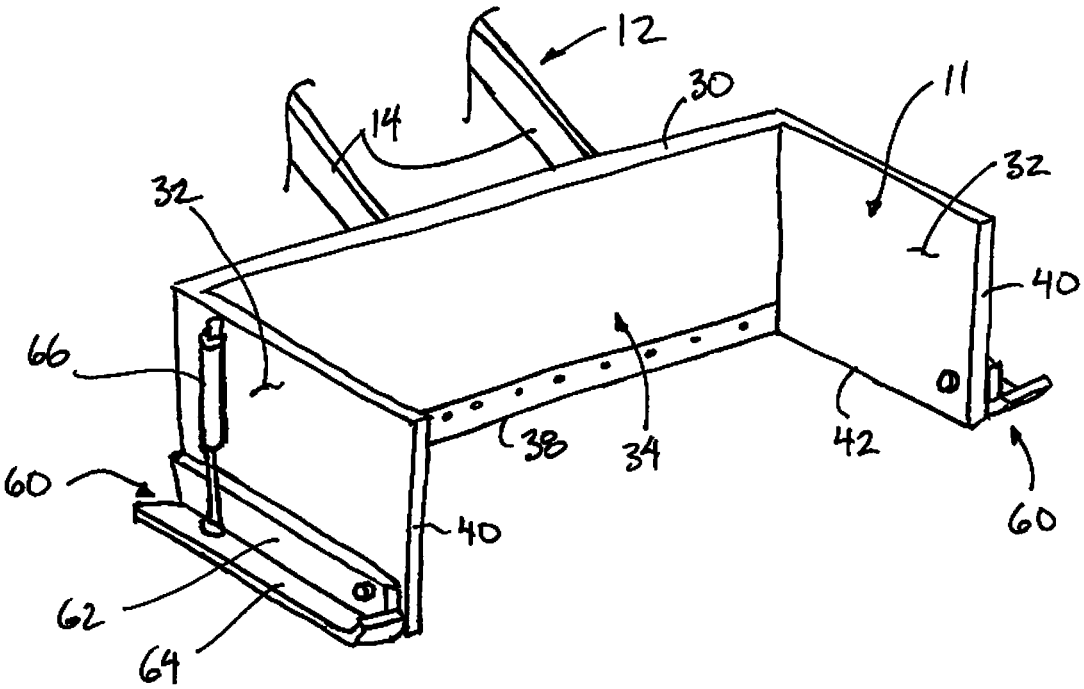
FIG. 1 is a perspective view of the excavator blade assembly according to a first embodiment of the present invention.
Figure 2:
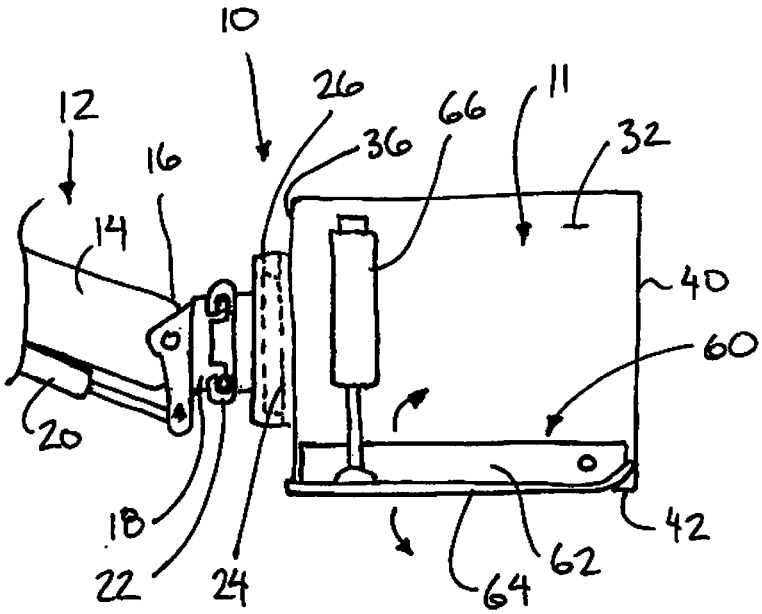
FIG. 2 is a side elevational view of the excavator blade assembly according to the first embodiment of FIG. 1.
Figure 4:
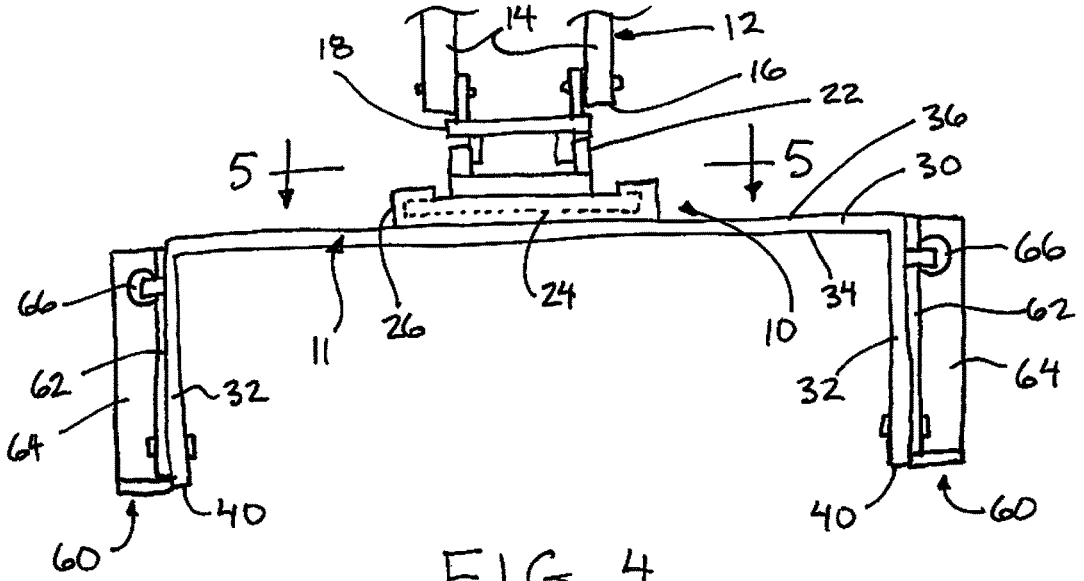
FIG. 4 is a top plan view of the excavator blade assembly according to the first embodiment of FIG. 1.
Figure 3:
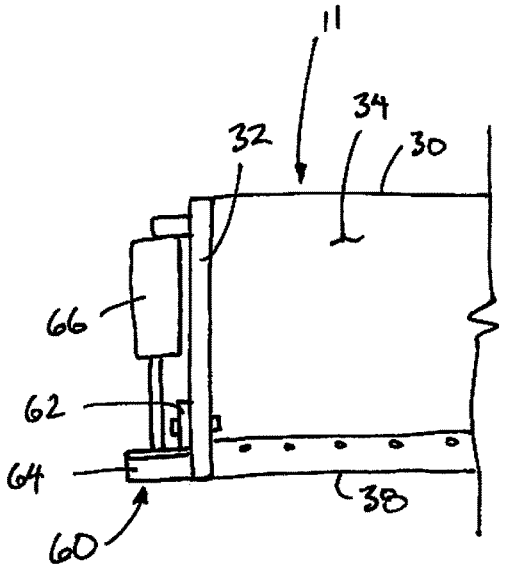
FIG. 3 is a front elevational view of an end portion of the excavator blade assembly according to the first embodiment of FIG. 1.
Figure 5:
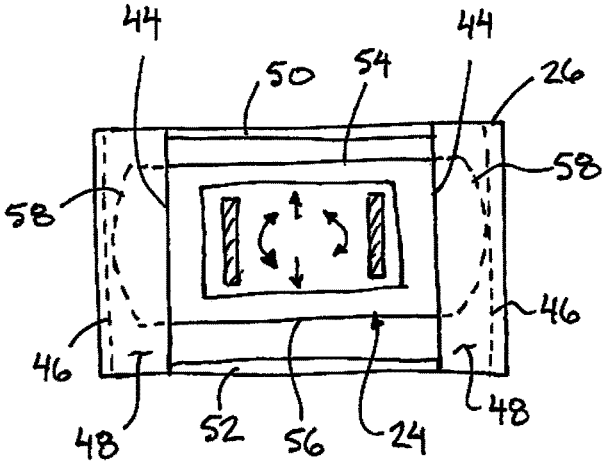
FIG. 5 is a rear elevational view of the mounting frames at a rear of the excavator blade assembly according to the first embodiment of FIG. 1.

Referring to the accompanying figures there is illustrated an earth levelling blade assembly generally indicated by reference numeral 10. The assembly 10 is suited for supporting a leveling blade 11 on the lift arms 14 of a loader 12.

A typical loader 12 comprises a loader frame supported on wheels for rolling movement along the ground in a forward working direction of the loader. Two lift arms 14 are pivotally coupled to the loader frame at respective rear ends so as to be pivotal about a common lateral axis oriented transversely to the forward working direction of the loader. The lift arms extend forwardly in parallel relation to one another at laterally spaced apart positions from the loader frame towards respective forward ends 16. A first coupling frame 18 is mounted in connection between the front ends of the lift arms so as to be pivotal about a common lateral axis relative to the lift arms as controlled by a tilt actuator 20. A second coupling frame 22 is arranged for releasable connection relative to the first coupling frame 18 using any commercially available quick connect system typically comprising pins and hooks which receive the pins therein with latching elements to selectively retain the pins within the hooks and selectively fix the second coupling frame relative to the first coupling frame in a releasable manner.

The leveling blade 11 according to the first illustrated embodiment of FIGS. 1 to 5 is an earth leveling box blade generally comprising a main blade portion 30 spanning the full width of the blade in the lateral direction between opposing ends of the blade and two side walls 32 extending forwardly from opposite ends of the main blade portion in perpendicular relation thereto.

In further embodiments, the earth levelling blade assembly may be applied to a grader blade in which the blade consists of a single cutting edge across the bottom of the blade extending between opposing ends of the blade.

In the illustrated embodiment, the main blade portion 30 includes a front working face 34 which faces forwardly and spans substantially the full height and full width of the blade for collecting material on the forward working face and spreading the collected material. The main blade portion 30 also includes a rear mounting face 36 opposite from the front working face which faces rearwardly and which is adapted for mounting onto the second coupling frame of the loader using the assembly 10 as described further herein. The bottom end of the front working face 34 terminates at a bottom cutting edge 38 spanning laterally across the full width of the blade and which is adapted for cutting material from the ground as the leveling blade is pushed forwardly across the ground. The side walls 32 of the blade 11 have inner surfaces which are generally parallel to one another and which protrude forwardly to respective front edges 40 which are upright and generally parallel to the front working face 34 of the blade. The side walls 32 terminate at respective bottom cutting edges 42 which lie in a common plane with one another and with the bottom cutting edge 38 of the main blade portion 30.

The assembly 10 according to the present invention generally includes a first mounting frame 24 arranged to be fixed onto the second coupling frame 22 of the loader and a second mounting frame 26 arranged to be fixed onto the leveling blade 11. A coupling arrangement between the first and second mounting frames (i) supports the second mounting frame to be freely pivotal about a forward axis relative to the first mounting frame and (ii) supports the second mounting frame to freely translate relative to the first mounting frame along an upright axis. The first mounting frame is typically fixed onto the second coupling frame with the tilt actuator 20 of the loader controlled so that the forward axis lies generally horizontally oriented in the forward working direction of the loader.

The first mounting frame 24 is a flat rigid plate while the second mounting frame 26 forms a pocket adapted to receive the flat rigid plate therein while allowing relative movement between the flat rigid plate and the pocket so as to support the second mounting frame for pivotal and translating movement as described above relative to the first mounting frame.

More particularly, the second mounting frame 26 generally comprises two channels 44 which are vertically oriented and mounted in fixed relation to the rear mounting face 36 of the leveling blade at laterally spaced apart positions. Each channel 44 comprises a first portion 46 comprising a side flange which is vertically oriented and projects perpendicularly outward from the rear mounting face of the blade. Each channel 44 further comprises a second portion 48 which comprises a rear flange projecting inwardly towards the opposing channel perpendicularly to the first portion and parallel to the rear mounting face of the blade. The second portion 48 is spaced rearwardly from the rear mounting face of the blade by the width of the first portion 46 which corresponds approximately to the thickness of the rigid plate forming the first mounting frame so as to receive the first mounting frame between the second portions 48 of the channels and the rear mounting face of the blade.

The second mounting frame further includes a top flange 50 and a bottom flange 52 enclosing the top and bottom ends of the two channels 44. The overall height of each channel between the top and bottom flanges thereof is greater than the corresponding height of the rigid plate forming the first mounting frame 24 received within the channels such that the first mounting frame and second mounting frame are adjustable in elevation relative to one another by allowing the first mounting frame to translate along an upright translating axis of the channels relative to the second mounting frame. As shown in the Figures, the upright translating axis of the channels is perpendicular to the bottom cutting edge 38 of the levelling blade and perpendicular to the forward axis of rotation of the second mounting frame relative to the first mounting frame. The top edge 54 and the bottom edge 56 of the plate forming the first mounting frame are straight and parallel to one another at opposing top and bottom ends of the first mounting frame to define the overall height of the first mounting frame.

The rigid plate of the first mounting frame 24 further includes two side edges 58 at laterally opposing sides of the frame which are connected between the top and bottom edges 54 and 56 of the plate. Both side edges 58 are convex so as to define constant radius of curvatures both having a center of curvature commonly located at the forward axis which is laterally centred between the opposing side edges 58. The overall width of the rigid plate forming the first mounting frame between the opposing side edges 58 along a diametrical axis passing through the forward axis is substantially equal to the lateral space defined between the first portions 46 of the two channels 48 to snugly receive the width of the plate therebetween while still allowing sliding movement of each side edge 58 of the plate within the channels 44.

Due to the centre of curvature of each convex side edge being located at the same forward axis centred on the mounting plate, the mounting plate can be rotated about the forward axis relative to the second mounting frame 26 while the side edges 58 remain snugly received between the first portions 46 of the two channels 44 respectively. In this manner the second mounting frame can rotate about the forward axis relative to the first mounting frame without any translation therebetween while also allowing vertical translation between the first and second mounting frames without any rotation about the forward axis. The second mounting frame is otherwise not constrained relative to the first mounting frame such that the second mounting frame can be freely translated or freely rotated or a combination thereof relative to the first mounting frame.

In this instance the loader arms can be set at a suitable elevation with the leveling blade engaged upon the ground such that the first mounting frame is located at an intermediate height near the centre of the vertical range of movement of the first mounting frame relative to the second mounting frame. As the loader is displaced forwardly across the ground, the leveling blade 11 is free to be displaced upwardly or downwardly relative to the lift arms while following ground contours by displacing the second mounting frame in either direction up or down relative to the first mounting frame, while also permitting the second mounting frame connected to the leveling blade to pivot about the forward axis relative to the first mounting frame supported on the loader arms. The rotational movement and translating movement are independent of one another according to ground contours being followed by the leveling blade as the loader is displaced forwardly across the ground.

To assist the leveling blade in riding over the ground in a level orientation, the assembly 10 further comprises two shoes 60 supported at laterally opposing ends of the leveling blade 11. Each shoe comprises an upright side plate 62 which is mounted parallel against the outer surface of a respective one of the side walls 32 of the leveling blade 11, and a bottom plate 64 extending perpendicularly outward from the bottom edge of the side plate of the shoe. In this manner the upright side plate is vertically oriented and parallel to the forward working direction while the bottom plate is generally horizontal in orientation to extend laterally outwardly from the bottom of the side plate along substantially the full depth of the leveling blade 11 in the forward working direction.

The bottom plate 64 has a flat bottom face suitable for engagement upon the ground to ride in sliding engagement along the ground as the blade is displaced forwardly with the loader. A forward edge of the bottom plate may be curved upwardly to define a ramped surface that assists the shoe in riding up and over small obstacles.

The side plate 62 has a flat inner surface which is parallel to the flat inner surface of the corresponding side wall of the blade upon which it is supported. The side plate 62 also spans the full depth of the blade in the forward working direction. When the bottom plate 64 is lowered below the elevation of the bottom cutting edge of the respective side wall, the upright side plate 62 spans the gap between the bottom edge of the side wall and the ground along a full depth of the side wall in the forward working direction.

The upright side plate 62 is pivotally coupled to the side wall 32 at the corresponding end of the blade 11 in proximity to the front end of the side plate 62 of the shoe and in proximity to the front edge of the side wall 32. The pivot connections of the shoes are aligned with one another such that the shoes are independently pivotal relative to the leveling blade 11 about a common lateral axis oriented perpendicularly to the forward working direction. The bottom face of the bottom plate of each shoe is near in elevation to the common cutting plane of the bottom cutting edges of the blade at the forward end of the shoe at the location of the pivot axis. As each shoe is pivoted about the common pivot axis, an opposing rear end of the bottom plate 64 will vary in elevation relative to the common cutting plane of the bottom cutting edges of the blade.

Each shoe includes a respective actuator 66 associated therewith in the form of a hydraulic linear actuator which can be extended and retracted in length. The actuator is mounted in an upright orientation at the exterior side of the respective side wall 32 of the blade over the rear end of the shoes so as to be pivotally coupled to the side wall of the blade at the top end thereof and pivotally coupled to the rear end of the shoe at the bottom end thereof. The overall range of movement of the actuator 66 is such that the actuator can be either extended or retracted from a neutral position with the bottom face of the shoe at the rear end thereof lying approximately in the common cutting plane of the bottom cutting edges of the blade.

More particularly, the actuator can be extended to a lowermost position of the respective shoe in which the bottom face of the shoe at the rear end thereof is spaced below the common cutting plane of the bottom cutting edges of the blade. Alternatively, the actuator of each shoe can be retracted to an uppermost position of the respective shoe in which the bottom face of the shoe at the rear end thereof is spaced above the common cutting plane of the bottom cutting edges of the blade.

In use, the shoes can be operated in unison to extend below the common cutting plane of the bottom cutting edges of the blades by a common prescribed amount so that the bottom cutting edge of the main blade portion is raised evenly above the ground across the width thereof. In this manner the blade is well suited for spreading an even amount of material carried on the front working face of the blade to be deposited through the gap below the bottom cutting edge of the main blade portion as the loader is displaced forwardly.

The shoes can be raised from the lowermost position to more aggressively engage the bottom cutting edge of the main blade portion of the blade with the ground for scraping the ground, or for cutting material from the ground as the loader is displaced forwardly. Raising the shoes above the elevation of the rear cutting edge of the main blade portion of the blade 11 allows the bottom cutting edges of the blade to cut most aggressively into the ground.

In some instances, for example when scraping snow and ice from streets with curbs, it may be desirable to raise one of the shoes at a time to an uppermost position spaced above the bottom cutting edge of the blades to raise the rear end of the shoe above the height of the curbs to prevent damage to the assembly 10 and to enable the bottom cutting edge of the rear blade portion to scrape closer to the curb.

In all instances of the operation of the box blade, it is desirable to position the lift arms at an intermediate elevation corresponding to the rigid plate of the first mounting frame 24 being located at mid-elevation within the pocket formed by the second mounting frame 26 such that the blade is supported for free, floating movement relative to the loader lift arms to be deflected either upwardly or downwardly while following ground contours.

In further embodiments, each shoe may be supported by one or more vertically oriented tracks along the outer side of the corresponding side wall of the blade such that the shoe is supported for vertical sliding movement between the lowermost and uppermost positions thereof relative to the bottom cutting edges of the blade instead of the pivoting movement described above. In the instance of vertical sliding support of each shoe relative to the blade, the actuator 86 of the shoe may be centered in the forward working direction relative to the shoe to lift and lower the shoe in a balanced configuration.

In further embodiments, the shoes 60 can be supported at opposing ends of a levelling blade in the form of a conventional grader blade having a single cutting edge extending along the bottom of the blade between opposing ends of the blade. In this instance, an additional mounting bracket can be mounted at each end of the blade on the rear side mounting side of the blade to support the shoes 60 thereon. The shoes would be supported as described above to be adjustable in height relative to the bottom cutting edge of the grader blade to enable the bottom cutting edge of the grader blade to be supported at different heights above the ground for spreading material as may be desired.

Figure 6:
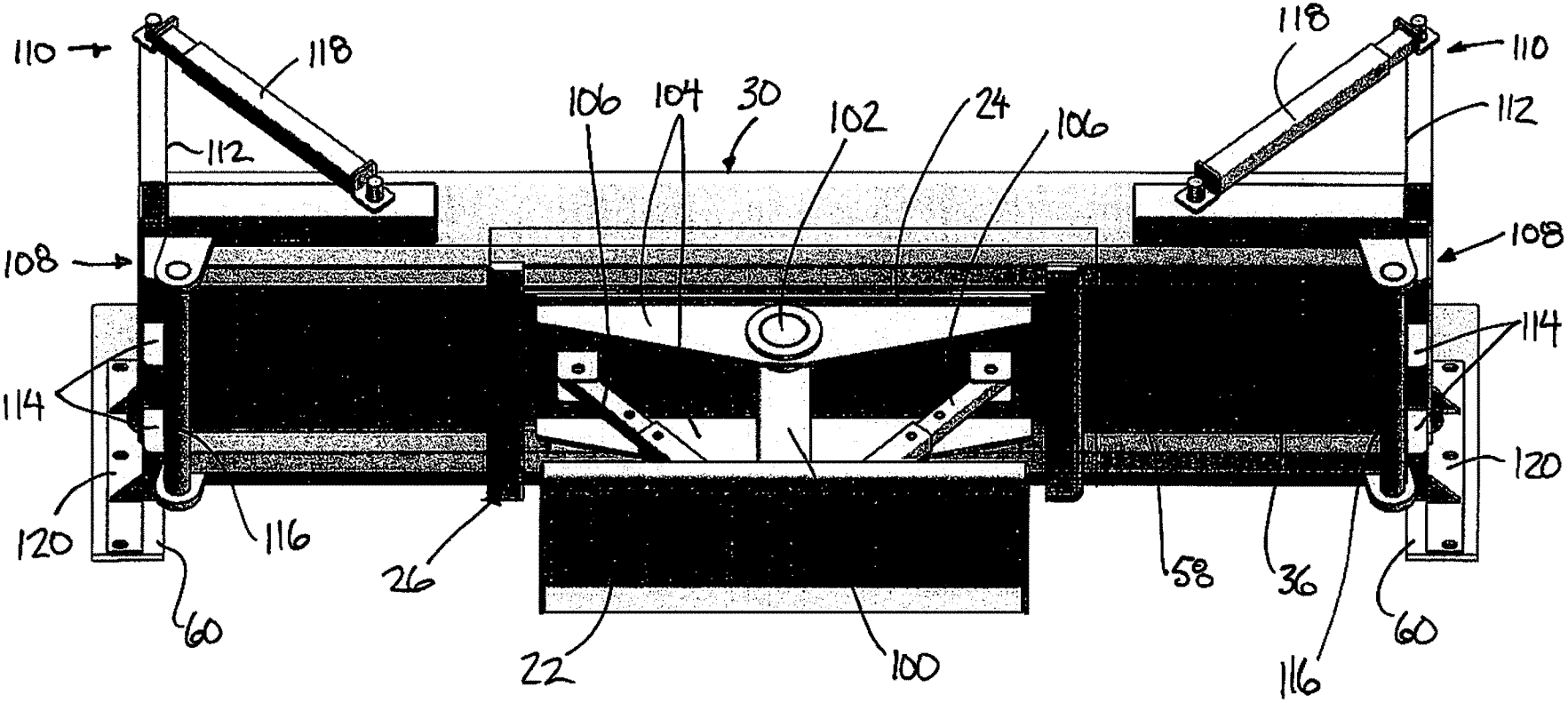
FIG. 6 is a perspective view of the excavator blade assembly according to a second embodiment of the present invention with both side walls shown in the forward position.
Figure 7:
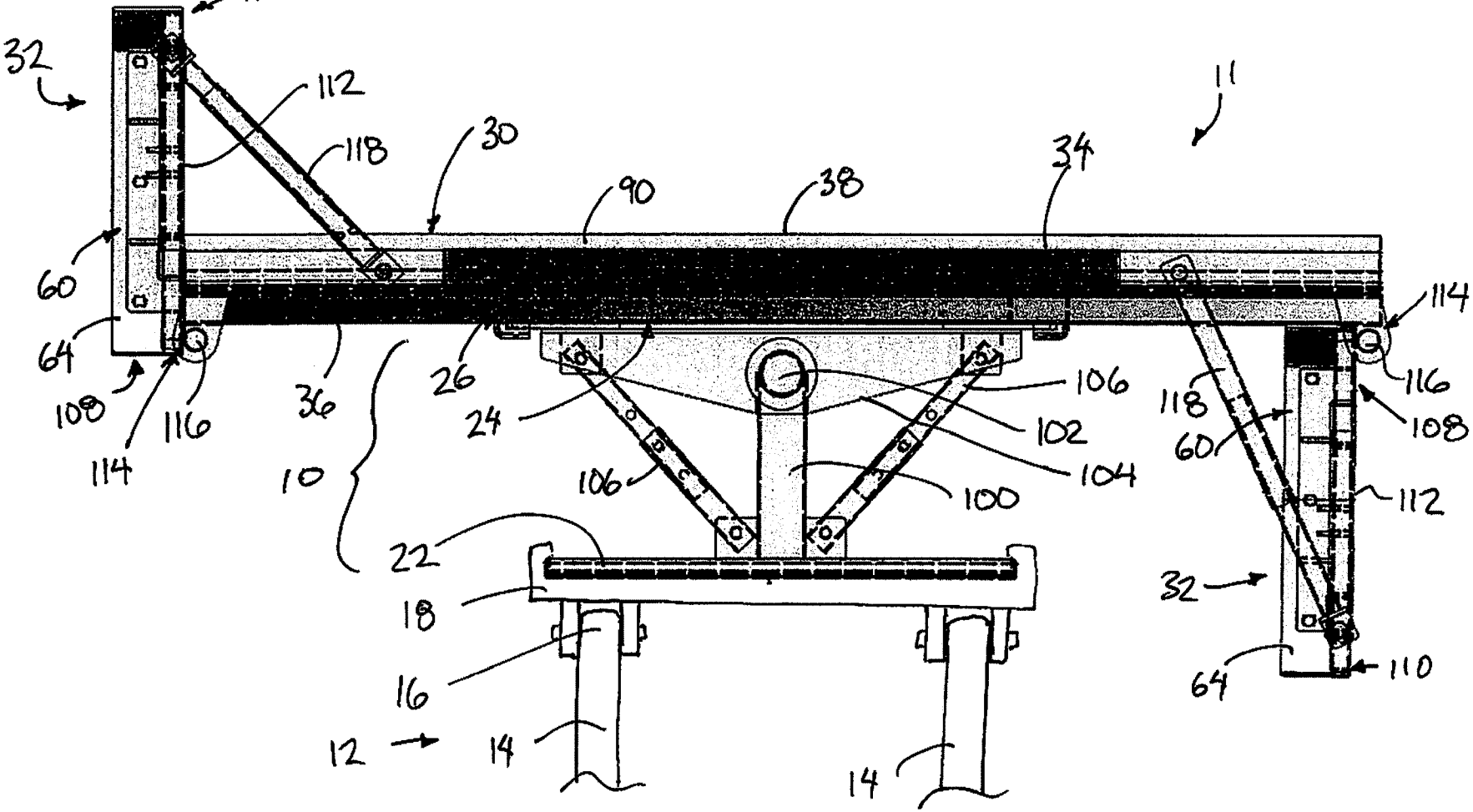
FIG. 7 is a top view of the excavator blade according to the second embodiment of FIG. 6 in which one of the side walls is in the forward position and one of the side walls is in the rearward position.
Figure 8:
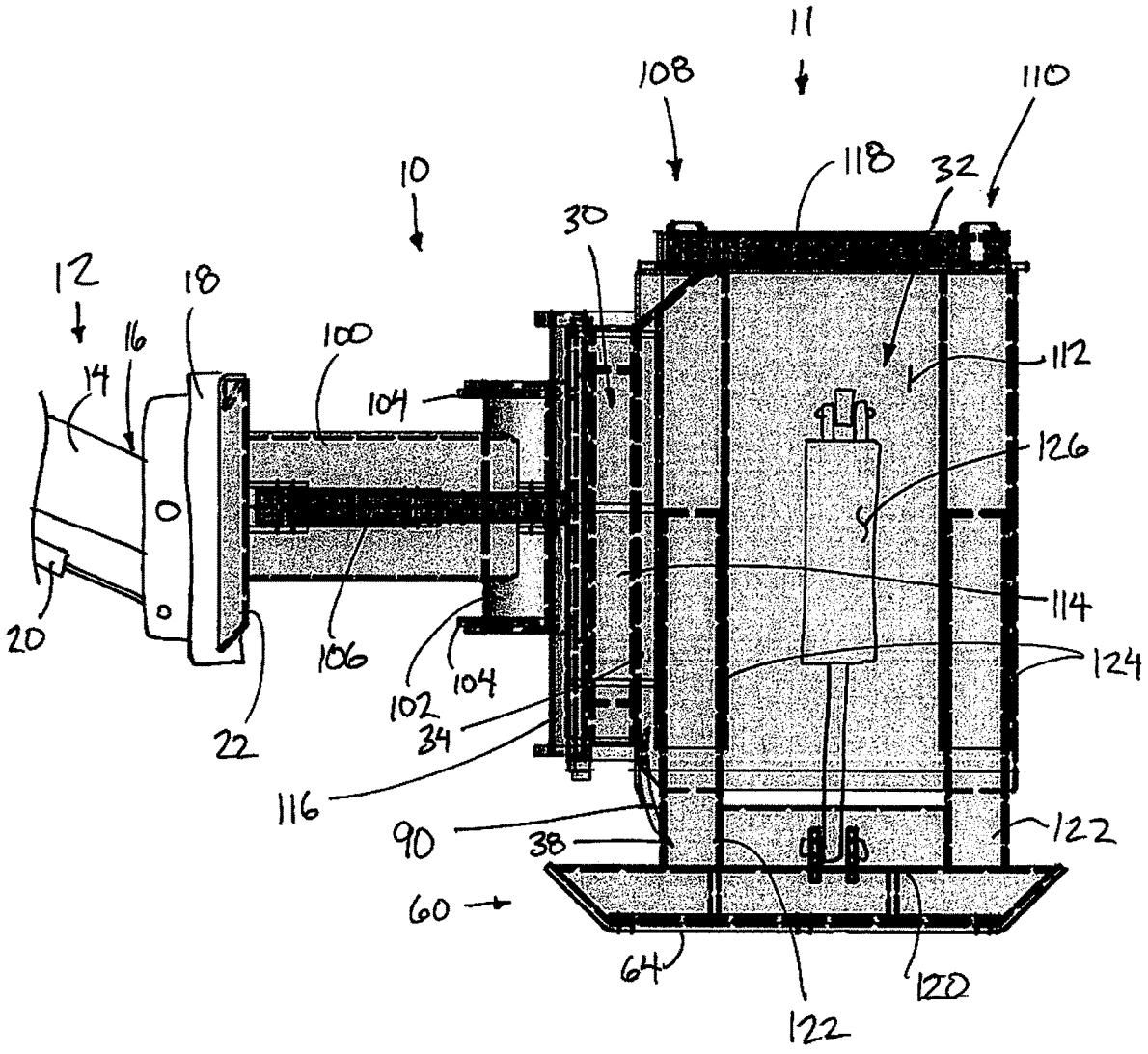
FIG. 8 is a side elevational view of the excavator blade according to the second embodiment of FIG. 6 in which both of the side walls are in the forward position.
Figure 9:
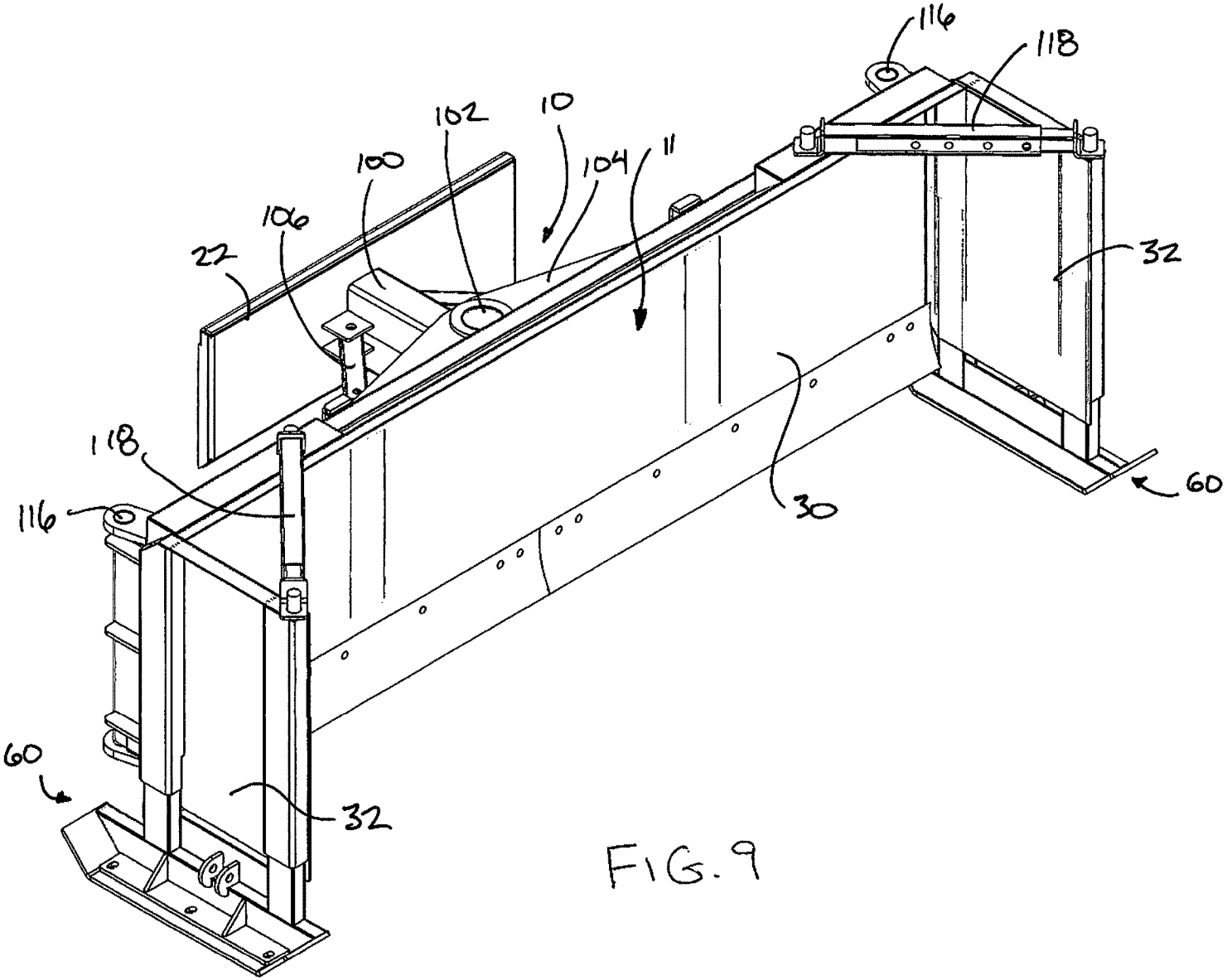
FIGS. 9, 10 and 11 are different perspective views of the excavator blade according to the second embodiment of FIG. 6.
Figure 10:
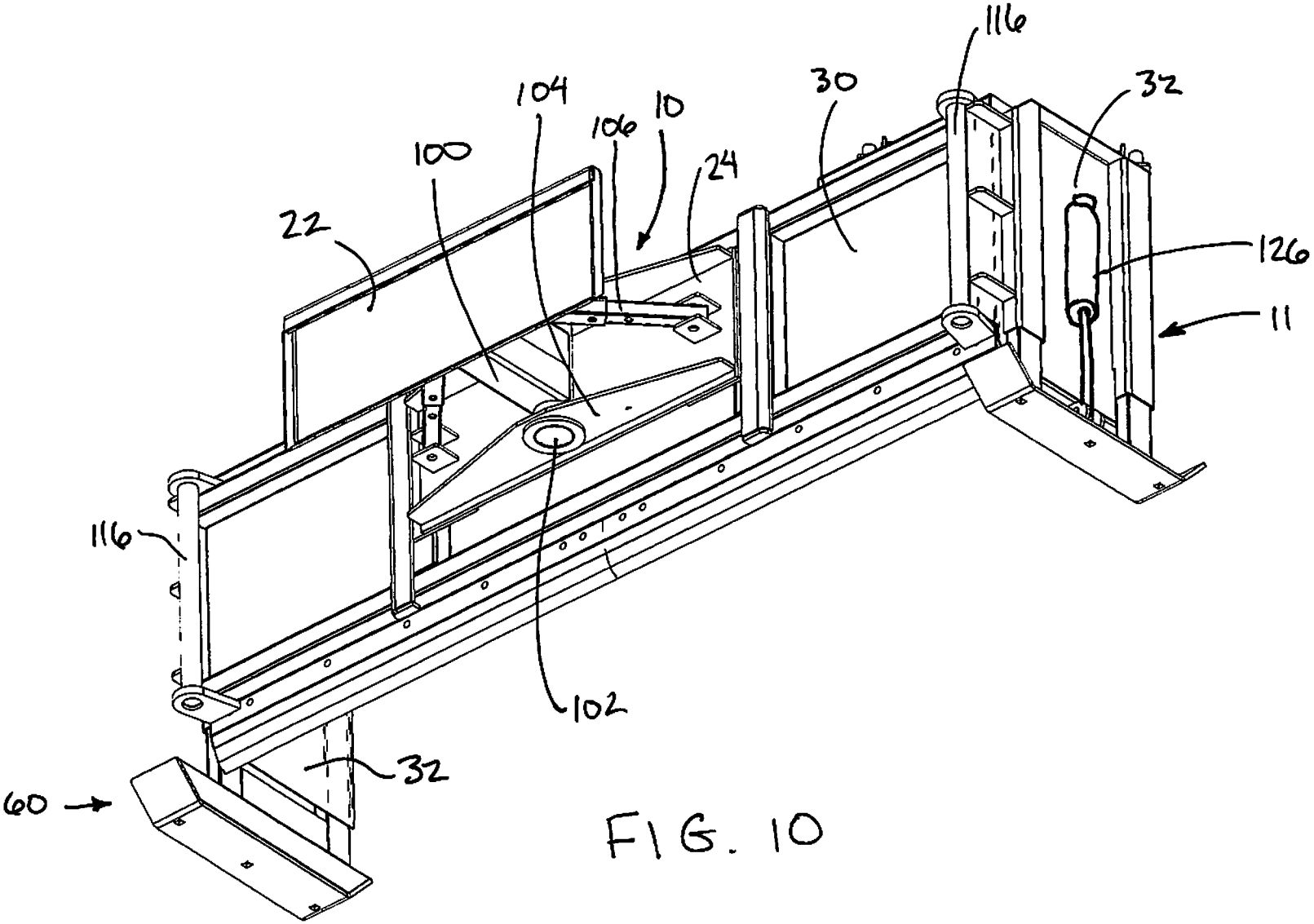
Figure 11:
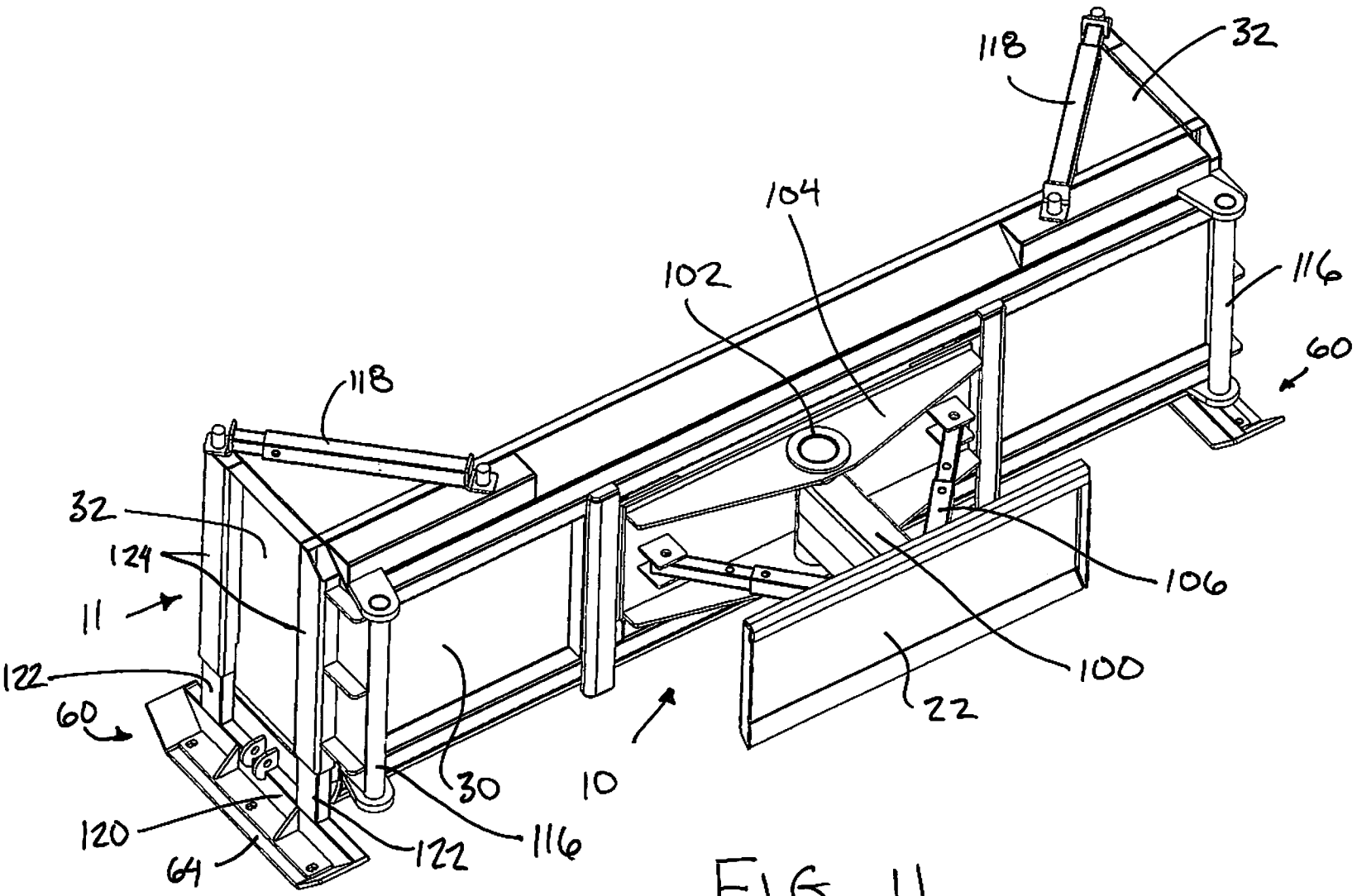

Turning now to FIGS. 6 through 8, a second embodiment of the leveling blade 11 will now be described. In this instance, the leveling blade again comprises a main blade portion 30 extending in the lateral direction between two opposing ends with a bottom cutting edge 38 being defined along the bottom of the main blade portion. The main blade portion again also comprises a front working face 34 facing forwardly and a rear mounting face 36 opposite the front working face that faces rearwardly. The front and rear faces of the main blade portion 30 are primarily formed by rigid sheet material which may be structurally reinforced by stiffening members secured along the rear of the sheet material to form a unitary structural body. The sheet material is substantially vertical in orientation in a normal working position.

A wear plate 90 is attached along the bottom of the main sheet material which protrudes below the main unitary structural body to define the bottom cutting edge 38 of the main blade portion thereon. The wear plate 90 is attached with replaceable fasteners to replace if required. The wear plate 90 has a slightly concave forward face such that the angle of attack of the bottom cutting edge is slightly negative by sloping up and rear from the cutting edge, while the main portion of the main blade portion above the wear plate 90 remains substantially vertical in orientation in normal use.

A coupling arrangement is again provided that includes a second mounting frame 26 defining a pocket on the rear mounting face 36 of the blade as described in the previous embodiment for similarly receiving a plate 24 of the first mounting frame therein with the plate being similarly configured for rotation about a forward axis relative to the blade due to the curved edges 58 while also being able to translate vertically within the pocket. The second embodiment is also similar in that a second coupling frame 22 is connected to the plate 24 of the first mounting frame such that the second coupling frame 22 can be releasably attached to a first coupling frame 18 on the lift arms 14 of a loader 12 as described above.

The second embodiment differs from the previous embodiment in the configuration of the first mounting frame forming the connection between the second coupling frame 22 and the plate 24 received in the pocket of the second mounting frame 26. More particularly the first mounting frame in this instance includes a first portion 100 fixed onto the plate 22 of the second coupling frame and a second portion 104 fixed onto the plate 24 to be received within the pocket of the second mounting frame 26.

The first mounting frame in this instance includes a support arm 100 fixedly mounted on the plate 22 of the second coupling frame to extend forwardly therefrom and define the first portion 100 of the first mounting frame. A pivot shaft 102 is supported at the forward end of the support arm 100 to define an upright pivot axis lying parallel to the front and rear faces of the main blade portion of the leveling blade. A pair of mounting plates 104 define the second portion of the first mounting frame, in which the mounting plates 104 extend rearward from the rear face of the plate 24 at spaced positions along the upright axis of the pivot shaft to be pivotally coupled to the pivot shaft 102 at spaced positions therealong. The mounting plates are perpendicular to the upright axis. In this arrangement, the plate 24 forming the second portion 104 of the first mounting frame is pivotal relative to the support arm forming the first portion 100 that is fixed onto the second coupling frame 22 by the connection of the pivot shaft 102 therebetween. The blade is thus pivotal with the second portion 104 through a range of angular orientations relative to the first portion 100 on the coupling plate 22 about the upright axis of the pivot shaft 102.

Two brace arms 106 are provided to function as locking members that selectively fix the second portion 104 of the first mounting frame relative to the first portion 100 of the first mounting frame at a selected one of a plurality of angular orientations about the upright axis. The brace arms 106 are each hinged at respective rear ends onto the plate 22 of the second coupling frame at laterally opposed sides of the support arm 100 to extend forwardly therefrom in laterally outward diverging relationship relative to one another towards the plate 24 of the first mounting frame. The forward ends of the brace arms 106 are hinged onto the plate 24 at laterally spaced positions on opposing sides of the pivot shaft 102. The brace arms lie in a common plane oriented perpendicularly to the upright axis and are arranged such that pivoting the angular orientation of the blade relative to the lift arms of the loader about the upright axis causes the brace arms 106 to be extended or retracted in length in opposition to one another. Each brace arm is a telescoping member with cooperating apertures therein such that a transverse pin can be inserted through the cooperating apertures to selectively fix the length of each brace arm which in turn selectively locks the angular orientation of the leveling blade relative to the loader arms about the pivot shaft 102.

The leveling blade of the second embodiment also differs from the previous embodiment in the configuration of the side walls 32. In this instance each side wall is pivotal between a forward position in which the side wall extends forwardly from the main blade portion 30 from an inner end 108 to an outer end 110 of the side wall and a rearward position in which the side wall extends rearwardly from the main blade portion 30 from the inner end 108 to the outer end 110 of the side wall. Each side wall again generally comprises a wall member 112 formed of a rigid sheet of material which lies generally perpendicularly to the lateral direction of the main blade portion 30 in both of the forward and rearward position thereof.

Each side wall further includes a mounting arm 114 at the inner end of the wall member 112 which connects the wall member to a pivot shaft 116 that is mounted at the rear side of the main blade portion 30. More particularly, both pivot shafts are supported at a location spaced rearwardly from the rear mounting face 36 and spaced laterally inwardly from the corresponding end of the main blade portion 30 with which it is associated. In this instance, in the forward position, the mounting arm 114 of each side wall extends laterally outward along the rear side of the main blade portion from the pivot shaft 116 to the inner end of the respective wall member 112.

Each side wall is pivoted through a range of approximately 180 degrees from the forward position to the rearward position such that in the rearward position each mounting arm 114 extends laterally inwardly from the respective pivot shaft 116 towards the inner and 108 of the respective side wall. Due to the offset of the upright axis of each pivot shaft 116 to be spaced rearwardly and laterally inwardly from the respective end of the main blade portion 30, the resulting position of the side walls in the rearward position is to be recessed laterally inwardly from the respective end of the main blade portion 30 while in a trailing relationship. In the forward position however, each side wall is abutted to the outer end of the main blade portion such that the inner face of the wall member 112 is closely abutted with the upright end face of the main blade portion 30 and such that the inner face of the wall member 112 and the front working face 34 of the main blade portion are joined to one another with minimal or no gap therebetween.

In order to secure each side wall within the respective forward or rearward position thereof, a mounting member 118 is manually secured as a triangular brace between the perpendicularly oriented side wall and main blade portion 30. Each mounting member is an elongated structural beam configured at an inner end to be pinned to the main blade portion 30 at the top end thereof above the front working face of the blade at a location spaced laterally inwardly from the respective end of the main blade portion, and configured at an outer end to be pinned to the side wall at the top end thereof above the interface of the side wall at a location spaced radially from the pivot shaft 116 towards the outer end 110 of the side wall.

Each mounting member 118 may be a telescoping member that is adjustable in length comprising an inner bar slidably received within an outer bar with transverse apertures in both to receive a locking pin through cooperating ones of the transverse apertures to selectively fix the length of the mounting member. In this manner, each mounting member can be fixed at a first length spanning between the mounting locations on the main blade portion and the side wall in the forward position and fixed at a second length (greater than the first length) spanning between the mounting locations on the main blade portion and the side wall in the rearward position. The same mounting locations on the main blade portion and the side wall are used in both the forward and rearward positions, however the mounting member for each side wall can be removed and reattached each time the side wall is displaced between the forward and rearward positions for simplifying the mounting structure.

Similarly to the previous embodiment, a pair of shoes 60 are supported on the two side walls 32 respectively. The shoes 60 are again adjustable in height between a raised position in which the bottom face of the shoes is at the same elevation with or spaced above the bottom cutting edge of the main blade portion 30, and a lowered position in which the bottom face of the shoes are spaced below the bottom cutting edge of the main blade portion 30.

In the forward position, the shoes 60 are supported at the outer sides of the wall members 112 of the two side walls 32 respectively. As the side walls are displaced into the rearward position, the shoes 60 become offset laterally inwardly relative to the respective end of the main blade portion 30 together with the side wall so as not to interfere with normal operation of the main blade portion 30 when the side walls are in the rearward position.

Each shoe comprises a bottom plate 64 and a rigid crossmember 120 secured along the top of the bottom plate 64 to strengthen the bottom plate. Longitudinally opposed ends of the bottom plate 64 protrude beyond both ends of the crossmember 120 and are curved lightly upwardly to define a ramped edge for riding over small bumps and debris on the ground regardless of the forward or rearward direction of the shoe.

Two posts 122 extend upwardly from the crossmember 120 at longitudinally spaced apart positions on each shoe 60. The posts 122 are received within two sleeves 124 that are fixedly attached to the outer side of the wall member 112 of the respective side wall 32. The posts 122 are vertically slidable within the respective sleeves 124 fixed onto the outer side of the wall member 112 of the respective side wall to support the shoes for vertical translating movement together with the posts between the raised and lowered positions thereof.

A hydraulic actuator 126 is mounted between the sleeves 124 to be pivotally coupled at a fixed location on the other side of the wall member 112 at a first end of the actuator and to be pivotally connected at an opposing second end of the actuator onto the crossmember 120 of the respective shoe 60. The actuator 126 is a linear piston cylinder configuration which can be hydraulically extended and retracted to control the raising and lowering of the shoe between the raised and lowered positions thereof or hold the shoe at a selected height between the raised and lowered positions.

The hydraulic actuators 126 associated with the two shoes 60 respectively are operable independently of one another such that the shoes 60 can be independently positioned in the raised or lowered positions thereof or supported at a variety of different elevations throughout a range of elevations between the raised and lowered positions respectively.

Similarly, each of the side walls 32 can be independently pivoted into and secured in either one of the forward or rearward positions independently of the other. The extension and retraction of the shoes between their raised and lowered positions can also be accomplished regardless of the positioning of the respective side wall in either the forward position or the rearward position.

The adjustable shoes which can be positioned either forwardly or rearwardly of the main blade portion 30 together with the coupling arrangement provided by the plate 24 of the first mounting frame within the pocket 26 of the second mounting frame provide many advantageous uses for the levelling blade that are unseen in the prior art.

In a preferred use, the forward and rearward tilting of the blade corresponding to displacement of the forward working face 34 about a laterally oriented axis is controlled only by the tilt actuator 20 on the lift arms of the loader with the tilt actuator being locked to maintain a vertical orientation of the main blade portion 30. The floating movement between the plate 24 and the pocket 26 allows the leveling blade to translate up and down relative to the arms of the loader, while the curved edges 58 of the plate 24 within the pocket 26 allow the blade to be tilted side to side about a horizontal axis in the forward working direction. Accordingly, the levelling blade is supported for free vertical translating and a free side to side tilting of the blade relative to the lift arms while being locked in orientation about the laterally oriented axis.

Adjusting the height of the shoes allows the bottom cutting edge of the main blade portion to be controlled at a level gap above ground level across the full width of the blade if desired, or allows one end of the blade to be purposely lowered relative to the other by lifting of the corresponding shoe at the lower end of the blade. If it is desired to move material across the face of the blade to be discharged along one end of the blade, the side wall at the discharge end of the blade can be pivoted rearwardly while still controlling the height at that end of the blade by extending and retracting the shoe 60 to the desired height while the shoe remains in a trailing relationship behind the blade.

By locking the tilting of the blade about a laterally oriented axis and only allowing floating movement by tilting about the forward axis or vertical translating, the leveling blade remains balanced even when one of the side walls is in a forward leading orientation and the other side wall is in a rearward trailing orientation.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An earth levelling blade assembly for supporting a levelling blade having a front working face and a rear mounting face on the lift arms of a loader movable across ground in a forward working direction, the assembly comprising:

a first mounting frame arranged to be releasably attached onto the lift arms of the loader;

a second mounting frame arranged to be fixedly attached to the rear mounting face of the levelling blade;

a coupling arrangement between the first and second mounting frames that (i) supports the second mounting frame to be freely pivotal about a forward axis relative to the first mounting frame in which the forward axis is oriented in the forward working direction of the loader and (ii) supports the second mounting frame to freely translate relative to the first mounting frame along an upright axis;

wherein one of the first and second mounting frames comprises a mounting plate and wherein another one of the first and second mounting frames comprises a pair of channels receiving opposing side edges of the mounting plate slidably therein; and wherein the side edges of the mounting plate are convex having a centre of curvature at the forward axis.

2. The assembly according to claim 1 wherein the second mounting frame is coupled to the first mounting frame such that the second mounting frame can translate along the upright axis relative to the first mounting frame without any corresponding rotation of the second mounting frame relative to the first mounting frame about the forward axis.

3. The assembly according to claim 1 wherein the channels extend in a direction of the upright axis such that the side edges of the mounting plate are slidable within the respective channels in the direction of the upright axis.

4. The assembly according to claim 1 wherein the first mounting frame comprises the mounting plate.

5. The assembly according to claim 1 wherein the first mounting frame further comprises (i) a first portion arranged to be secured to the lift arms of the loader, (ii) a second portion connected to the second mounting frame by the coupling arrangement, (iii) a pivot shaft pivotally coupling the second portion to the first portion for relative pivotal movement about an upright swing axis through a range of different angular orientations, and (iv) a locking member arranged to couple the second portion to the first portion in fixed relation to one another at a selected one of the different angular orientations.

6. The assembly according to claim 1 further comprising a pair of shoes supported at opposing ends of the levelling blade, each shoe having a bottom face arranged for sliding engagement along the ground, and each shoe being supported on the respective end of the levelling blade such that at least a portion of the shoe is adjustable in height relative to a bottom cutting edge of the levelling blade.

7. The assembly according to claim 6 in combination with the levelling blade, wherein the levelling blade comprises a box blade having (i) a main blade portion extending in a lateral direction transversely to the forward axis in which the main blade portion defines the front working face of the levelling blade and defines a bottom cutting edge of the levelling blade and (ii) a pair of side walls extending forwardly from laterally opposing ends of the main blade portion, the shoes being supported on the side walls respectively.

8. The assembly according to claim 6 in combination with the levelling blade wherein the levelling blade further comprises:

a main blade portion extending in a lateral direction transversely to the forward axis in which the main blade portion defines the front working face of the levelling blade and defines a bottom cutting edge of the levelling blade, and a pair of side walls supported at laterally opposing ends of the main blade portion respectively;

each side wall being movable between a forward position extending forwardly from the respective end of the main blade portion and a rearward position extending rearwardly from the respective end of the main blade portion; and the shoes being supported on the side walls respectively.

9. The assembly according to claim 8 wherein each side wall is pivotal about a respective upright pivot axis between the forward position and the rearward position thereof.

10. The assembly according to claim 9 wherein the upright pivot axis of each side wall is spaced rearwardly and spaced laterally inwardly from the respective end of the main blade portion.

11. The assembly according to claim 8 wherein the side walls are movable between the respective forward and rearward positions independently of one another.

12. The assembly according to claim 8 wherein each shoe is supported on the respective end of the levelling blade such that the bottom face is movable from a lowered position spaced below the bottom cutting edge of the levelling blade to a raised position at a common elevation with or spaced above the bottom cutting edge of the levelling blade.

13. An earth levelling blade assembly for use with a loader movable across ground in a forward working direction in which the loader includes lift arms, the assembly comprising:

a levelling blade having a front working face, a rear mounting face opposite the front working face, and a bottom cutting edge along a bottom of the levelling blade;

a first mounting frame arranged to be releasably attached onto the lift arms of the loader;

a second mounting frame fixedly attached to the rear mounting face of the levelling blade;

a coupling arrangement between the first and second mounting frames that (i) supports the second mounting frame to be freely pivotal about a forward axis relative to the first mounting frame in which the forward axis is oriented in the forward working direction of the loader and (ii) supports the second mounting frame to freely translate relative to the first mounting frame along a translating axis oriented perpendicularly to the bottom cutting edge of the levelling blade and perpendicularly to the forward axis.

14. The assembly according to claim 13 wherein the second mounting frame is coupled to the first mounting frame such that the second mounting frame can translate along the upright axis relative to the first mounting frame without any corresponding rotation of the second mounting frame relative to the first mounting frame about the forward axis.

15. The assembly according to claim 13 wherein one of the first and second mounting frames comprises a mounting plate and wherein another one of the first and second mounting frames comprises a pair of channels receiving opposing side edges of the mounting plate slidably therein such that the mounting plate is pivotal about the forward axis and translatable along the translating axis relative to the pair of channels.

16. The assembly according to claim 15 wherein the mounting plate is supported for floating movement relative to the channels.

17. The assembly according to claim 15 wherein the side edges of the mounting plate are convex having a centre of curvature at the forward axis.

18. The assembly according to claim 15 wherein the first mounting frame comprises the mounting plate.

19. The assembly according to claim 13 wherein the second mounting frame comprises a pair of channels defining the translating axis, the channels extending perpendicularly to the bottom cutting edge of the levelling blade.

* * * * *